US005685521A

United States Patent [19]

Yoshida et al.

[11] Patent Number: 5,685,521

[45] Date of Patent: Nov. 11, 1997

[54] THROTTLE VALVE CONTROL DEVICE

[75] Inventors: Akira Yoshida; Hisashi Hikichi, both of Kakuda, Japan

[73] Assignee: Hadsys, Inc., Miyagi-ken, Japan

[21] Appl. No.: 628,957

[22] Filed: Apr. 8, 1996

[30] Foreign Application Priority Data

Apr. 7, 1995 [JP] Japan ..... 7-082456

[51] Int. Cl.[6] ..... F02D 9/00

[52] U.S. Cl. ..... 251/313; 123/196; 123/400

[58] Field of Search ..... 251/313; 123/396, 123/400

[56] References Cited

U.S. PATENT DOCUMENTS

| | | | |
|---|---|---|---|
| 4,951,771 | 8/1990 | Maehara | 123/396 X |
| 5,083,542 | 1/1992 | Kishinoto | 123/400 |

FOREIGN PATENT DOCUMENTS

| | | |
|---|---|---|
| 61-226530 | 10/1986 | Japan . |
| 62-130140 | 8/1987 | Japan . |
| 63-167037 | 7/1988 | Japan . |
| 5-086906 | 4/1993 | Japan . |
| 7-246857 | 9/1995 | Japan . |
| 2 221 890 | 7/1989 | United Kingdom . |

*Primary Examiner*—John Fox
*Attorney, Agent, or Firm*—Paul A. Guss

[57] ABSTRACT

A throttle drum with a first return spring disposed therearound is rotatably mounted on a throttle shaft, and a cruise control drum with a second return spring disposed therearound is rotatably disposed around the throttle drum. The throttle drum and the cruise control drum are arranged in a radially double-walled structure around the throttle shaft, which may be of a relatively short axial length.

16 Claims, 7 Drawing Sheets

PRIOR ART

THROTTLE VALVE CONTROL DEVICE

BACKGROUND OF THE INVENTION

1. Field of the Invention

The present invention relates to a throttle valve control device for rotating a throttle shaft about its own axis by holding an operating drum angularly movable by an accelerator pedal and an operating drum for cruise control independently against a throttle lever that is fixedly mounted on the throttle shaft.

2. Description of the Related Art

There has been known an automobile cruise control system which allows the driver of an automobile to drive the automobile constantly at a certain desired speed without the need for operating the accelerator pedal by turning on a cruise control switch at the time the automobile has reached the desired speed.

Various throttle valve control devices incorporating such an automobile cruise control system have been proposed in the art (see, for example, Japanese laid-open utility model publication No. 62-130140). One such proposed throttle valve control device will be described below with reference to FIG. 7 of the accompanying drawings.

As shown in FIG. 7, a throttle shaft 4 is integrally joined to a throttle valve 2 which is supported by a valve casing 1, and a valve opening/closing lever (throttle lever) 6 is fixedly mounted on the throttle shaft 4. The valve opening/closing lever 6 has an engaging arm 8 spaced from and extending parallel to the throttle shaft 4. On the throttle shaft 4, there are angularly movably mounted a first operating member 10 connected to an accelerator pedal (not shown) and a second operating member 12 connected to a cruse control system (not shown). The first and second operating members 10, 12 are angularly movable independently of each other and associated with respective return springs 14, 16. When the first operating member 10 or the second operating member 12 engages the engaging arm 8, it angularly moves the throttle shaft 4 about its own axis for thereby opening or closing the throttle valve 2.

In order to allow the first and second operating members 10, 12 to turn smoothly on the throttle shaft 4, the first and second operating members 10, 12 have respective drums 10*a*, 12*a* which are mounted on the throttle shaft 4 in axially adjacent relation to each other. The drums 10*a*, 12*a* have respective axial widths in the directions indicated by the arrow X, which are substantially greater than the widths of the first and second operating members 10, 12. The first and second operating members 10, 12 are positioned axially in tandem in the directions indicated by the arrow X. Therefore, the throttle shaft 4 is required to be of an axial length large enough to support the drums 10*a*, 12*a* thereon.

As a result, the span or distance from the point on the throttle shaft 4 where the load from the outermost second operating member 12 is applied to the bearing of the valve casing 1 which supports the throttle valve 2 is so large that the throttle shaft 4 tends to cause scuffing on itself and the valve casing 1 when the throttle valve 4 rotates. When the engine of the automobile vibrates and also the automobile vibrates while running, the throttle shaft 4 is subject to large vibrations, resulting in a large load imposed on the throttle shaft 4 and the bearing of the valve casing 1.

If the axial lengths of the drums 10*a*, 12*a* of the first and second operating members 10, 12 are reduced, then the durability of the return springs 14, 16 is lowered, and the first and second operating members 10, 12 become unstable in operation, tending to cause more scuffing on itself and the valve casing 1.

SUMMARY OF THE INVENTION

It is therefore an object of the present invention to provide a throttle valve control device which has a throttle shaft having a minimum axial length and two operating drums that are connected respectively to an accelerator pedal and a cruise control system and are smoothly and effectively angularly movable about the throttle shaft.

The above and other objects, features, and advantages of the present invention will become more apparent from the following description when taken in conjunction with the accompanying drawings in which preferred embodiments of the present invention are shown by way of illustrative example.

DETAILED DESCRIPTION OF THE PREFERRED EMBODIMENTS

Figure 1:
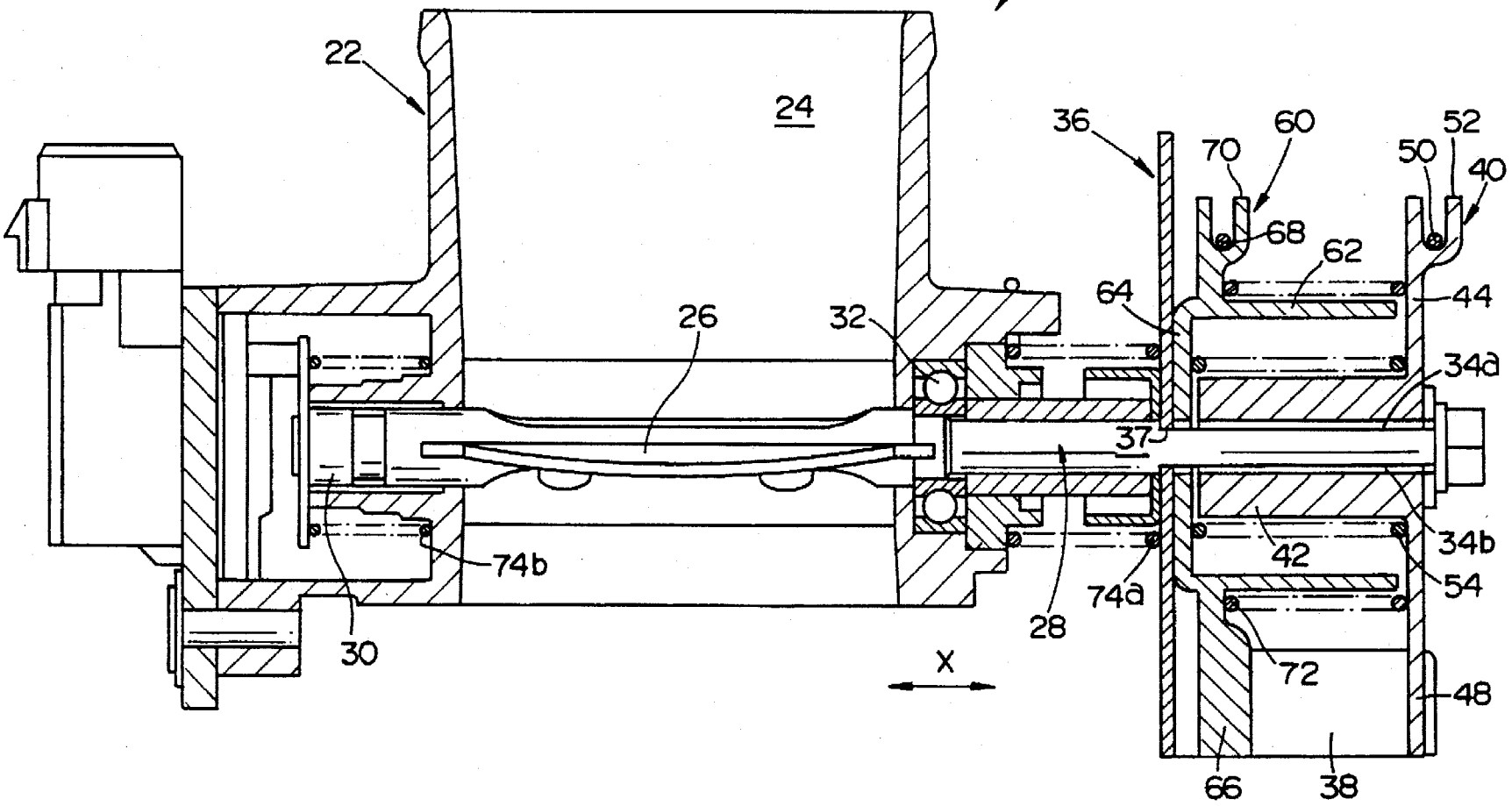
FIG. 1 is a vertical cross-sectional view of a throttle valve control device according to a first embodiment of the present invention.

FIG. 1 shows a throttle valve control device 20 according to a first embodiment of the present invention. The throttle valve control device 20 may be used in a fuel injector or a carburetor for an internal combustion engine. In the illustrated embodiment, the throttle valve control device 20 is incorporated in a fuel injector combined with the internal combustion engine of an automobile.

The throttle valve control device 20 includes a valve casing 22 having a passage 24 defined therein and a throttle valve 26 angularly movably mounted in the valve casing 44 for selectively opening and closing the passage 24. The throttle valve 26 is fixedly supported on a throttle shaft 28 which has an axial end 30 supported in the valve casing 22.

The throttle shaft 28 has an opposite axial end angularly movably supported in the valve casing 22 by a bearing 32 and terminating in a distal end portion which has a substantially elliptical cross section shaped by a pair of diametrically opposite recesses 34*a*, 34*b* defined therein. A throttle lever 36 is mounted on the distal end portion of the throttle shaft 28 and fixedly secured thereto by the recesses 34*a*, 34*b* for rotation therewith. The throttle lever 36 has a substantially elliptical central hole 37 which is complementary in shape to the substantially elliptical cross section of the throttle shaft 28. The throttle lever 36 includes an engaging arm 38 (see FIGS. 1 and 2) radially spaced outwardly from and axially expanding parallel to the throttle shaft 28 in the directions indicated by the arrows X.

A throttle drum (operating drum) 40 is rotatably mounted on the throttle shaft 28. The throttle drum 40 has a drum body 42 extending axially of the throttle shaft 28 and a disk 44 extending radially outwardly from an axial end of the drum body 42 and integrally formed therewith. The drum body 42 and the disk 44 may be formed separately from each other and then integrally joined to each other. The disk 44 includes a projecting bar 48 extending radially outwardly therefrom for engagement with the engaging arm 38. A first wire 50 fixed at one end thereof to the disk 44 extends through a guide 52 of U-shaped cross section and is connected to an accelerator pedal (not shown).

A first return spring 54 in the form of a coiled torsion spring-has an end fixed to the disk 44, and is disposed around the drum body 42. The other end of the first return spring 54 engages a support rod 56 secured to the valve casing 22. The first return spring 54 normally urges the throttle drum 40 to turn about its own axis in the direction indicated by the arrow B (see FIGS. 2 and 3) for thereby holding the projecting bar 48 against the support rod 56.

A cruise control drum (operating drum) 60 is rotatably mounted on the throttle shaft 28 around the first return spring 54. The cruise control drum 60 has a drum body 62 extending axially of the throttle shaft 28 and a disk 64 extending radially outwardly from an axial end of the drum body 62 and integrally formed therewith. The drum body 62 is disposed around and positioned coaxially with the drum body 42 of the throttle drum 40.

The drum body 62 has an opening (not shown) defined therein through which the other end of the first return spring 54 extends radially outwardly for engagement with the support rod 56. The disk 64 includes a projecting bar 66 extending radially outwardly therefrom for engagement with the engaging arm 38. A second wire 68 (see FIG. 1) which has an end fixed to the disk 64 extends through a guide 70 of U-shaped cross section and is connected to a cruise control system (not shown).

Figure 2:
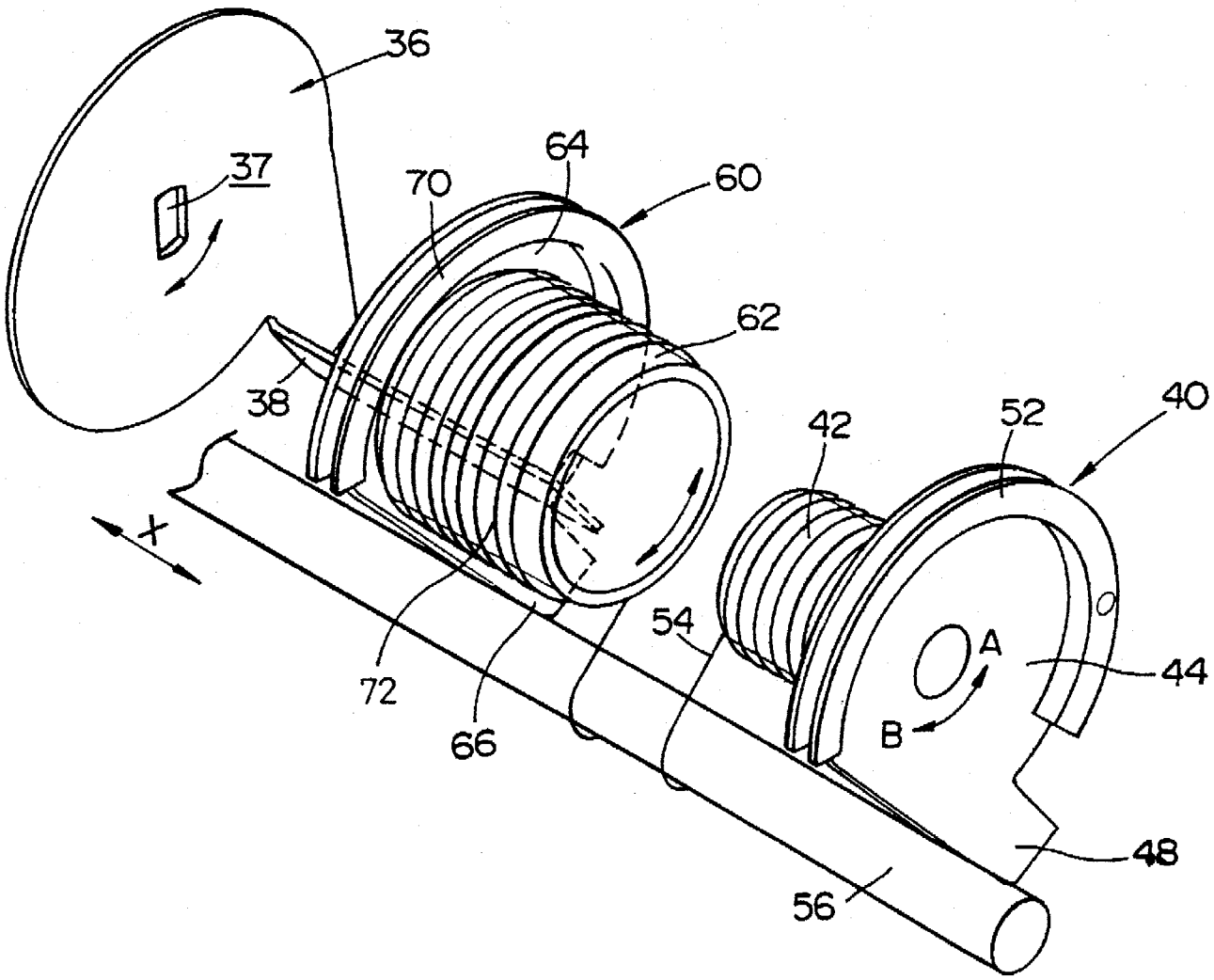
FIG. 2 is a perspective view of a portion of the throttle valve control device according to the first embodiment.

As shown in FIG. 2, a second return spring 72 in the form of a coiled torsion spring has an end fixed to the disk 64, and is disposed around the drum body 62. The other end of the second return spring 72 engages the support rod 56. The cruise control drum 60 is normally urged to turn about its own axis to hold the projecting bar 66 against the support rod 56 under the resiliency of the second return spring 72.

As shown in FIG. 1, a first throttle return spring **74*a* in the form of a coiled torsion spring is interposed between the throttle lever 36 and the valve casing 22 for returning the throttle valve 26 to close the passage 24, and a second throttle return spring 74*b* in the form of a coiled torsion spring is interposed between the axial end 30 of the throttle shaft 28 and the valve casing 22 for returning the throttle valve 26 to close the passage 24**.

Operation of the throttle valve control device 20 according to the first embodiment will be described below.

When the accelerator pedal and the cruise control system are not operated, the throttle valve 26 is returned to close the passage 24 under the bias of the first and second throttle return springs **74*a*, 74*b* as shown in FIG. 1**.

Figure 3:
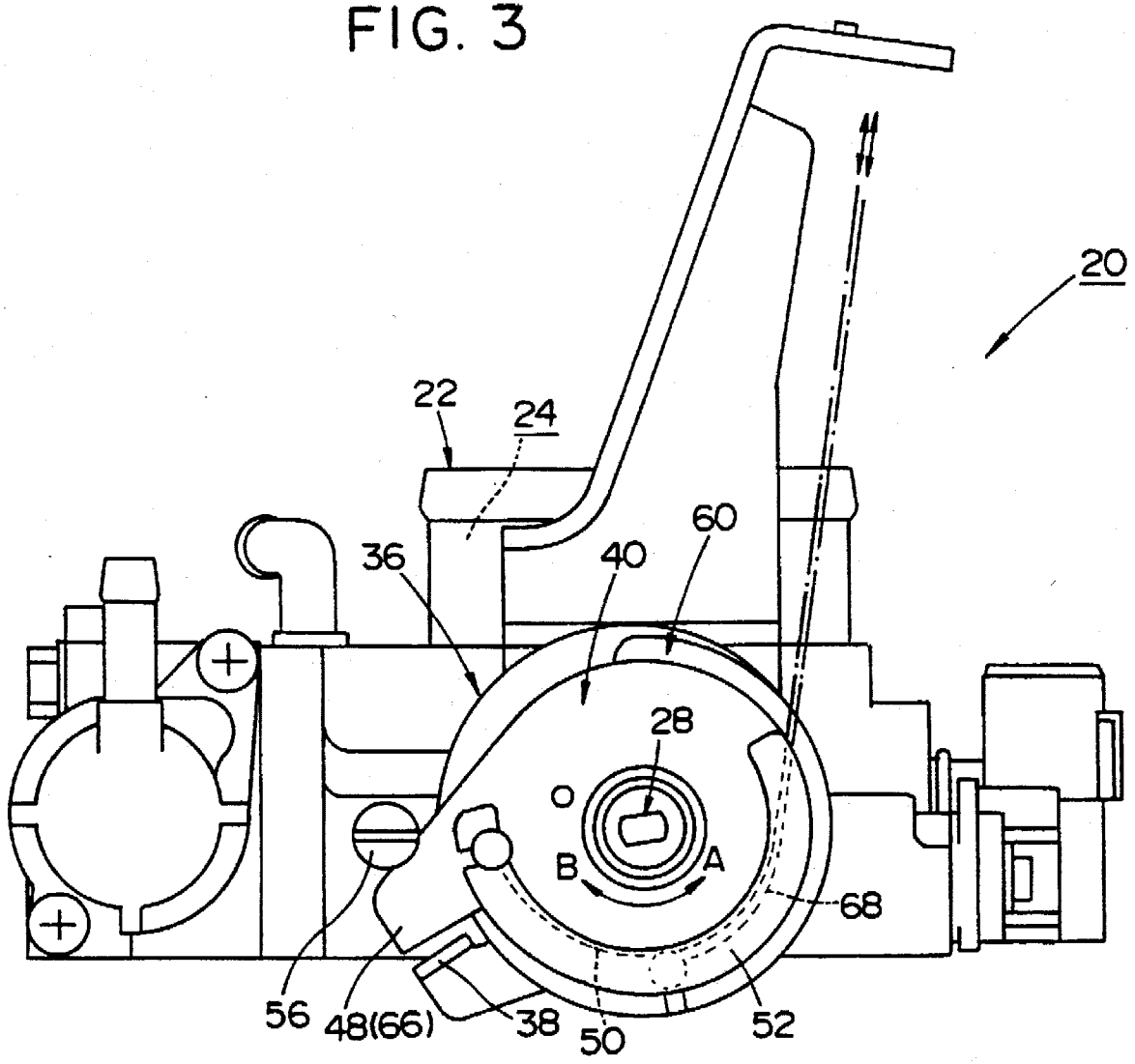
FIG. 3 is a side elevational view of the throttle valve control device according to the first embodiment.

When the accelerator pedal is depressed, the first wire 50 connected to the throttle drum 40 is pulled, rotating the throttle drum 40 in the direction indicated by the arrow A against the bias of the first return spring 54 as shown in FIG. 3. The projecting bar 48 of the throttle drum 40 presses the engaging arm 38 of the throttle lever 36 in the direction indicated by the arrow A, so that the throttle lever 36 angularly moves with the throttle shaft 28 in the direction indicated by the arrow A. When the throttle lever 36 thus rotates, the throttle valve 26 is angularly moved an angle depending on the depth to which the accelerator pedal is pressed, thus opening the passage 24.

At this time, the cruise control drum 60 is held in position under the bias of the second return spring 27 against angular movement with the throttle drum 40. When the accelerator pedal is released, the throttle drum 40 is angularly moved in the direction indicated by the arrow B under the bias of the first return spring 54, back to a return position in which the projecting bar 48 is held against the support rod 56.

When the second wire 68 is pulled by the cruise control system that is operated, the cruise control drum 60 to which the second wire 68 is secured is angularly moved in the direction indicated by the arrow A against the bias of the second return spring 72. The projecting bar 66 of the cruise control drum 60 presses the engaging arm 38, angularly moving the throttle lever 36 in the direction indicated by the arrow A. The throttle shaft 28 on which the throttle lever 36 is fixedly mounted is now held in a certain angular position established by the cruise control system. The automobile now runs at a constant speed. When the cruise control drum 60 angularly moves, the throttle drum 40 is prevented from angularly moving with the cruise control drum 60 by the first return spring 54.

In the first embodiment, the throttle drum 40 and the cruise control drum 60 are independently rotatably mounted on the throttle shaft 28 in a coaxially double-walled structure around the throttle shaft 28. Therefore, the throttle shaft 28 is much shorter than the throttle shaft of the conventional structure in which the throttle drum 40 and the cruise control drum 60 would be supported axially in tandem on the throttle shaft 28.

Consequently, the throttle valve control device 20 has a relatively compact overall size, allowing the throttle drum 40 and the cruise control drum 60 to be positioned as closely to the valve casing 22 as possible. When the engine of the automobile vibrates and also the automobile vibrates while running, the throttle shaft 4 is subject to relatively small vibrations, resulting in a greatly reduced load imposed on the throttle shaft 28 and the bearing 32 and neighboring regions.

Since the throttle drum 40 and the cruise control drum 60 are assembled in a radially double-walled structure, their drum bodies 42, 62 may be of a desired effective axial length axially of the throttle shaft 28. The entire weight of the throttle valve control device 20 may thus be reduced, and the throttle drum 40 and the cruise control drum 60 may be angularly moved smoothly on the throttle shaft 28.

Figure 4:
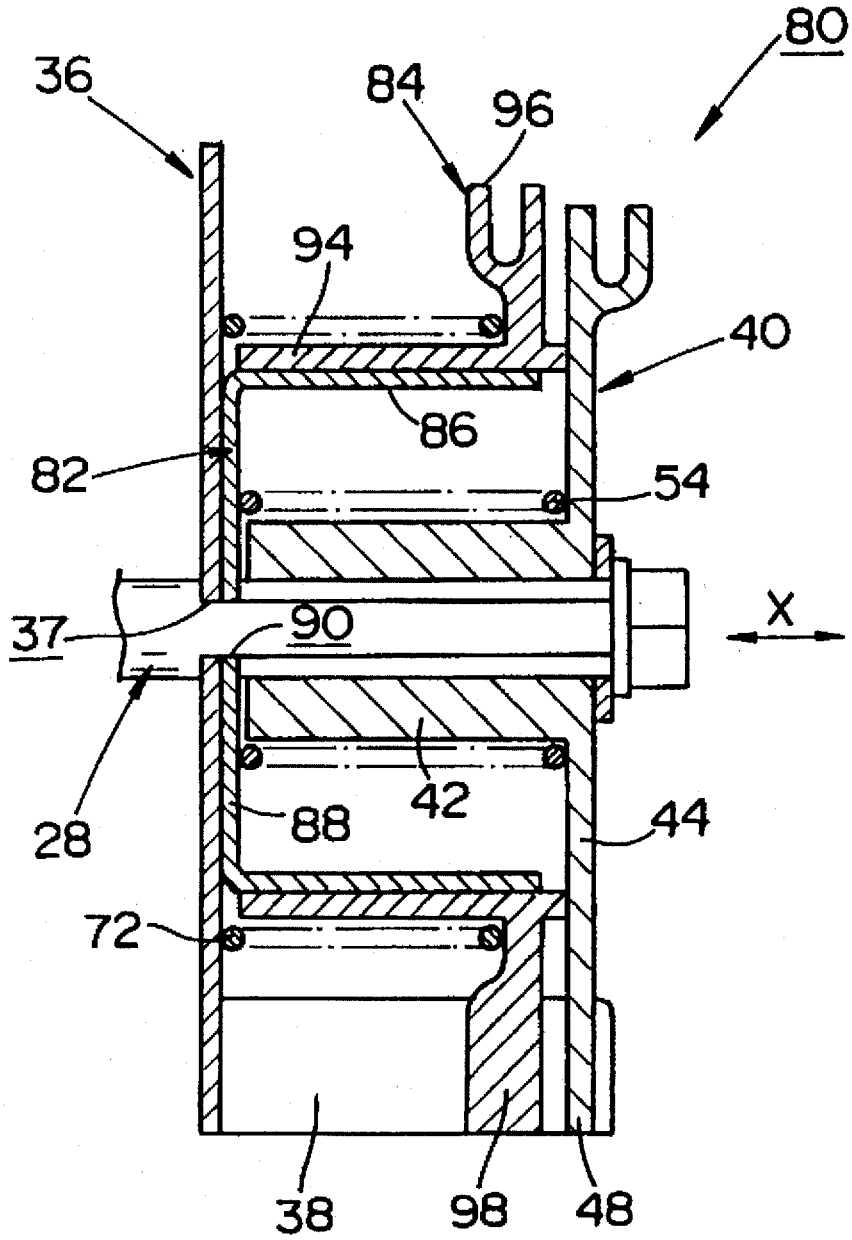
FIG. 4 is a fragmentary vertical cross-sectional view of a throttle valve control device according to a second embodiment of the present invention.

FIG. 4 shows a throttle valve control device 80 according to a second embodiment of the present invention. Those parts shown in FIG. 4 which are identical to those shown in FIG. 1 are denoted by identical reference numerals, and will not be described in detail below.

As shown in FIG. 4, the throttle valve control device 80 has a bearing guide 82 disposed radially outwardly of a throttle drum 40 on which a first return spring 54 is disposed, and a cruise control drum 84 on which a second return spring 72 is disposed is slidably mounted on an outer circumferential surface of the bearing guide 82.

Figure 5:
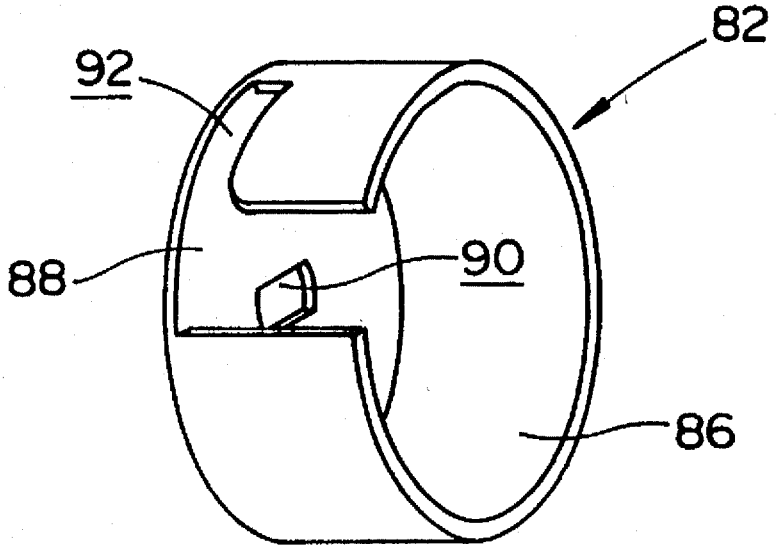
FIG. 5 is a perspective view of a guide member of the throttle valve control device according to the second embodiment.

The bearing guide 82 comprises a tubular body 86 radially spaced outwardly from and axially extending in the directions indicated by the arrow X parallel to a throttle shaft 28, and a disk 88 extending radially inwardly from and integral with an axial end of the tubular body 86. The disk 88 has a central hole 90 which is complementary in shape to the cross section of the throttle shaft 28. As shown in FIG. 5, the tubular body 86 has an opening 92 including a portion extending axially and having a certain width and another portion extending circumferentially adjacent to the disk 88. The opening 92 serves to pass the first return spring 54 radially outwardly therethrough.

The cruise control drum 84 is of a substantially tubular shape having a drum body 94, a guide 96, and a projecting bar 98. The drum body 94 is slidably disposed on the outer circumferential surface of the tubular body 86.

In the throttle valve control device 80 according to the second embodiment, the bearing guide 82 is angularly movable in unison with the throttle shaft 28, and the tubular body 86 supports the cruise control drum 84. Therefore, the cruise control drum 84 is allowed to angularly move smoothly and reliably around the throttle shaft 28. The cruise control drum 84 does not have any portion corresponding to the disk 64 of the cruise control drum 60 according to the first embodiment. Therefore, the cruise control drum 84 is simpler in shape than the cruise control drum 60 according to the first embodiment.

Figure 6:
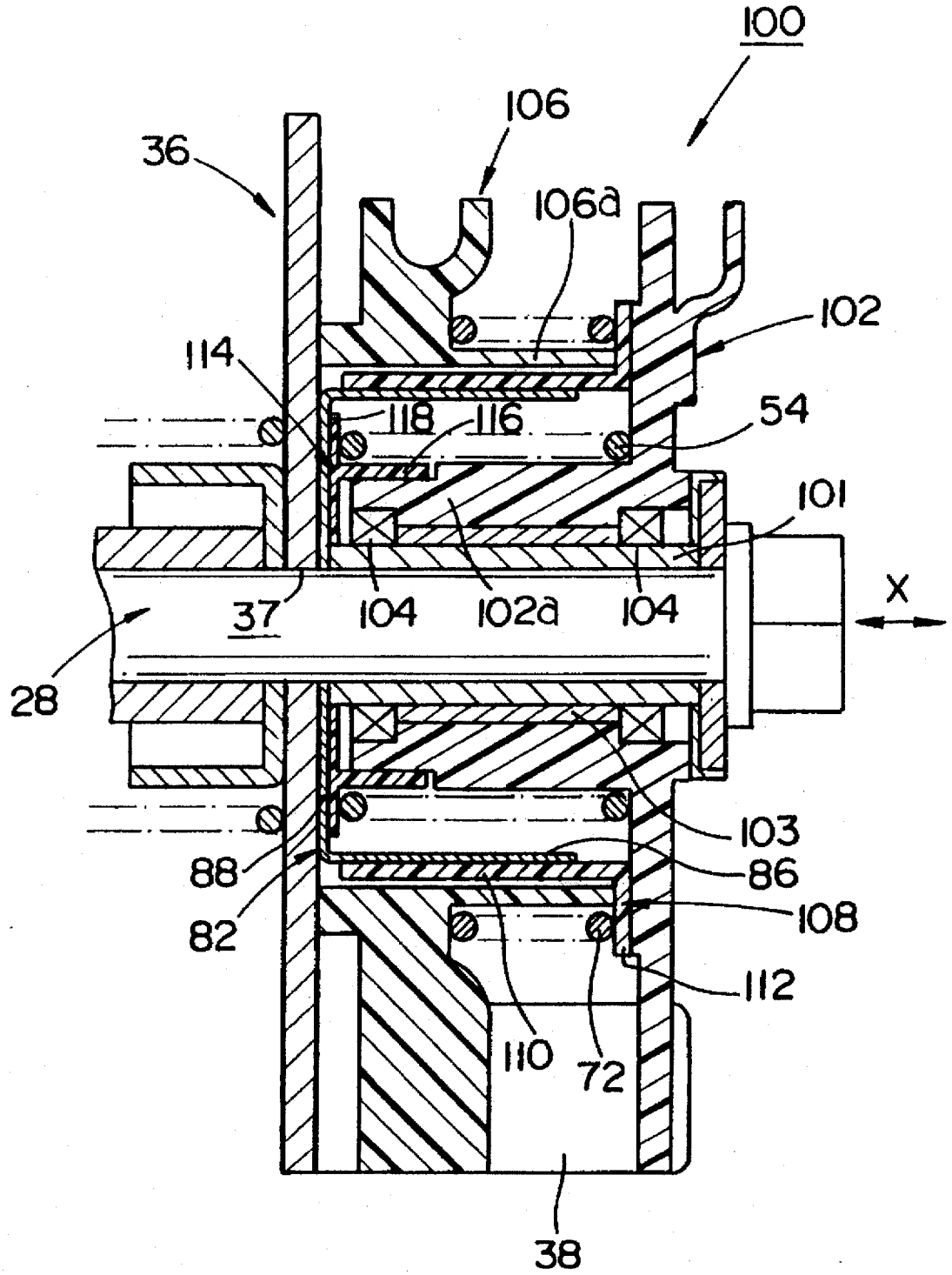
FIG. 6 is a fragmentary vertical cross-sectional view of a throttle valve control device according to a third embodiment of the present invention.
Figure 7:
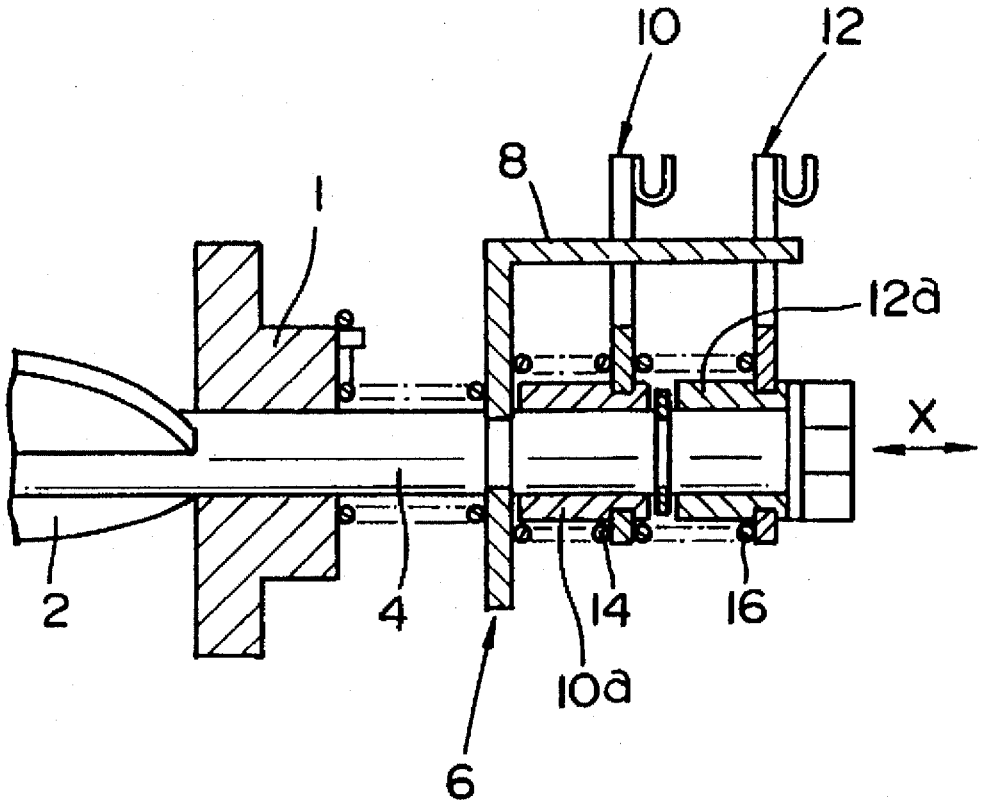
FIG. 7 is a fragmentary vertical cross-sectional view of a conventional throttle valve control device.

FIG. 6 shows a throttle valve control device 100 according to a third embodiment of the present invention. Those parts shown in FIG. 6 which are identical to those shown in FIGS. 1 and 4 are denoted by identical reference numerals, and will not be described in detail below.

As shown in FIG. 6, the throttle valve control device 100 has a throttle drum 102 is fitted over a set collar 101 and a metal insert 103 which are disposed over a throttle shaft 28. Axially opposite ends of the metal insert 103 are sealed by respective seals 104 disposed on the set collar 101. A cruise control drum 106 is disposed around the throttle drum 102, with a first support 108 interposed between a bearing guide 82 and the cruise control drum 106.

The first support 108 comprises a ring-shaped guide body 110 extending axially of the throttle shaft 28 in the directions indicated by the arrow X and radially spaced a clearance from the outer circumferential surface of a tubular body 86 of the bearing guide 82 or the inner circumferential surface of a drum body 106*a* of the cruise control drum 106, and a flange 112 extending radially outwardly from an axial end of the ring-shaped guide body 110 and bearing an end of a second return spring 72.

A second support 114 that is angularly movable with respect to the throttle shaft 28 is disposed between a drum body 102*a* of the throttled rum 102 and a disk 88 of the bearing guide 82. The second support 114 comprises a ring-shaped guide body 116 extending axially of the throttle shaft 28 and guiding a first return spring 54 thereon, and a flange 118 extending radially outwardly from an axial end of the ring-shaped guide body 116 and bearing an end of the first return spring 54.

The first support 108 and the second support 114 are made of a resin material. Although the throttle drum 102 and the cruise control drum 106 may be made of a metallic material, they are preferably made of a resin material.

In the third embodiment, the first support 108 is disposed between the bearing guide 82 fixed to the throttle shaft 28 and the cruise control drum 106 angularly movable with respect to the throttle shaft 28, and a certain clearance is defined between the ring-shaped guide body 110 of the first support 108 and the bearing guide 82 or the cruise control drum 106.

Due to the above clearance, the cruise control drum 106 can angularly move in unison with the first support 108 reliably with respect to the bearing guide 82, so that the cruise control drum 106 can angularly move smoothly without sticking.

The first and second supports 108, 114 provided in addition to the bearing guide 82 is effective to simplify the shape of the cruise control drum 106. The throttle drum 102 and the cruise control drum 106 can reliably be positioned and are allowed to angularly move highly smoothly.

With the flanges 112, 118 of the first and second supports 108, 114 bearing the first and second return springs 54, 72, respectively, the first and second supports 108, 114 are angularly moved under rotational forces imposed by the first and second return springs 54, 72. The first and second supports 108, 114 are thus prevented from damage, and the throttle drum 102, the throttle lever 36, and the bearing guide 82 are also prevented from damage. If they are made of a metallic material, then they are made highly resistant to corrosion by the above arrangement. The load on the throttle shaft 28 can be reduced because of a reduced axial length of the throttle drum 102 and the cruise control drum 106, and the throttle drum 102, the cruise control drum 106, and the first and second supports 108, 114 may be made of a resin material. As a consequence, the throttle valve control device 100 has a relatively small weight, and any vibrations to which they are subject are relatively small.

In the first through third embodiments, the throttle drum 40 (102) is mounted on the throttle shaft 28, and the cruise control drum 60 (84 or 106) is disposed around the throttle drum 40 (102). However, the cruise control drum 60 (84 or 106) may be disposed on the throttle shaft 28, and the throttle drum 40 (102) may be disposed radially outwardly of the cruise control drum 60 (84 or 106).

The throttle valve control devices according to the present invention offer the following advantages:

One of the operating drums on which the first return spring is disposed is mounted to the throttle shaft, and the other operating drum on which the second return spring is mounted is disposed around the first return spring. Therefore, the axial length of the throttle shaft is much smaller than the throttle shaft on which the two operating drums would be disposed axially in tandem on the throttle shaft. The operating drums may have relatively large axial lengths, respectively. Because of these positional and dimensional features, the throttle valve control devices according to the present invention are subject to relatively small vibrations, and the operating drums are allowed to angularly move independently and smoothly.

Although certain preferred embodiments of the present invention have been shown and described in detail, it should be understood that various changes and modifications may be made therein without departing from the scope of the appended claims.

What is claimed is:

1. A throttle valve control device comprising:

a throttle shaft;

a throttle lever fixedly mounted on said throttle shaft;

a first operating drum rotatably mounted on said throttle shaft and angularly movable by an accelerator pedal for engaging said throttle lever to angularly move said throttle shaft about its own axis;

a second operating drum disposed around said first operating drum and angularly movable by a cruise control system for engaging said throttle lever to angularly move said throttle shaft about its own axis;

a first return spring disposed around said first operating drum for normally urging said first operating drum to angularly move back to a predetermined position; and a second return spring disposed around said second operating drum for normally urging said second operating drum to angularly move back to a predetermined position.

2. A throttle valve control device according to claim 1, wherein said throttle lever has an engaging arm extending axially of said throttle shaft, said first operating drum and said second operating drum have respective projecting arms for individually engaging said engaging arm.

3. A throttle valve control device according to claim 1, further comprising:

a single support rod extending parallel to said throttle shaft, said first return spring and said second return spring have respective ends engaging said single support rod.

4. A throttle valve control device according to claim 1, further comprising:

a pair of supports disposed between said first operating drum and said second operating drum and angularly movable with respect to said throttle shaft;

said supports having respective ring-shaped guide bodies extending axially of said throttle shaft 28 and respective flanges extending radially from said ring-shaped guide bodies and bearing said first and second return springs, respectively.

5. A throttle valve control device according to claim 1, further comprising:

a bearing guide disposed between said first operating drum and said second operating drum, said second operating drum being supported by said bearing guide.

6. A throttle valve control device according to claim 5, wherein said bearing guide comprises:

a disk fixedly mounted on said throttle shaft; and a tubular body extending axially of said throttle shaft from said disk, said second operating drum being slidably supported on an outer circumferential surface of said tubular body.

7. A throttle valve control device according to claim 6, further comprising:

a first support disposed between said bearing guide and said second operating drum and angularly movable with respect to said throttle shaft;

said first support comprising a ring-shaped guide body extending axially of said throttle shaft and radially spaced a clearance from an outer circumferential surface of said bearing guide or an inner circumferential surface of said second operating drum, and a flange extending radially outwardly from said ring-shaped guide body and bearing an end of said second return spring.

8. A throttle valve control device according to claim 6, further comprising:

a second support disposed between said bearing guide and said first operating drum and angularly movable with respect to said throttle shaft;

said second support comprising a ring-shaped guide;

said second support comprising a ring-shaped guide body extending axially of said throttle shaft and guiding said first return spring, and a flange extending radially outwardly from said ring-shaped guide body and bearing an end of said first return spring.

9. A throttle valve control device comprising:

a throttle shaft;

a throttle lever fixedly mounted on said throttle shaft;

a first operating drum rotatably mounted on said throttle shaft and angularly movable by a cruise control system for engaging said throttle lever to angularly move said throttle shaft about its own axis;

a second operating drum disposed around said first operating drum and angularly movable by an accelerator pedal for engaging said throttle lever to angularly move said throttle shaft about its own axis;

a first return spring disposed around said first operating drum for normally urging said first operating drum to angularly move back to a predetermined position; and a second return spring disposed around said second operating drum for normally urging said second operating drum to angularly move back to a predetermined position.

10. A throttle valve control device according to claim 9, wherein said throttle lever has an engaging arm extending axially of said throttle shaft, said first operating drum and said second operating drum having respective projecting arms for individually engaging said engaging arm.

11. A throttle valve control device according to claim 9, further comprising:

a single support rod extending parallel to said throttle shaft, said first return spring and said second return spring having respective ends engaging said single support rod.

12. A throttle valve control device according to claim 9, further comprising:

a pair of supports disposed between said first operating drum and said second operating drum and angularly movable with respect to said throttle shaft;

said supports having respective ring-shaped guide bodies extending axially of said throttle shaft and respective flanges extending radially from said ring-shaped guide bodies and bearing said first and second return springs, respectively.

13. A throttle valve control device according to claim 9, further comprising:

a bearing guide disposed between said first operating drum and said second operating drum, said second operating drum being supported by said bearing guide.

14. A throttle valve control device according to claim 13, wherein said bearing guide comprises:

a disk fixedly mounted on said throttle shaft; and a tubular body extending axially of said throttle shaft from said disk, said second operating drum being slidably supported on an outer circumferential surface of said tubular body.

15. A throttle valve control device according to claim further comprising:

a first support disposed between said bearing guide and said second operating drum and angularly movable with respect to said throttle shaft;

said first support comprising a ring-shaped guide body extending axially of said throttle shaft and radially spaced a clearance from an outer circumferential surface of said bearing guide or an inner circumferential surface of said second operating drum, and a flange extending radially outwardly from said ring-shaped guide body and bearing an end of said second return spring.

16. A throttle valve control device according to claim 14, further comprising:

a second support disposed between said bearing guide and said first operating drum and angularly movable with respect to said throttle shaft;

said second support comprising a ring-shaped guide body extending axially of said throttle shaft and guiding said first return spring, and a flange extending radially outwardly from said ring-shaped guide body and bearing an end of said first return spring.

* * * * *